US008695550B2

(12) United States Patent
Ikuma

(10) Patent No.: US 8,695,550 B2
(45) Date of Patent: Apr. 15, 2014

(54) VALVE TIMING CONTROLLER

(71) Applicant: Denso Corporation, Kariya (JP)

(72) Inventor: Tomonobu Ikuma, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/688,380

(22) Filed: Nov. 29, 2012

(65) Prior Publication Data

US 2013/0133599 A1 May 30, 2013

(30) Foreign Application Priority Data

Nov. 29, 2011 (JP) ..... 2011-259928

(51) Int. Cl.
*F01L 1/34* (2006.01)

(52) U.S. Cl.
USPC ..... 123/90.17; 123/90.12

(58) Field of Classification Search
USPC ..... 123/90.17, 90.16, 90.15, 90.31; 137/625.25
See application file for complete search history.

(56) References Cited

U.S. PATENT DOCUMENTS 6,405,695 B2 * 6/2002 Mizutani et al. ..... 123/90.17
7,959,537 B2 * 6/2011 Sugiura et al. ..... 477/176
2001/0029914 A1 * 10/2001 Scheidt et al. ..... 123/90.15
2002/0078913 A1 * 6/2002 Fukuhara et al. ..... 123/90.17
2003/0196627 A1 10/2003 Lewis et al.
2005/0103297 A1 5/2005 Simpson
2006/0086332 A1 4/2006 Simpson et al.
2011/0259289 A1 * 10/2011 Fujiyoshi ..... 123/90.15

FOREIGN PATENT DOCUMENTS

JP 2009-222025 10/2009
JP 2011-196245 10/2011

OTHER PUBLICATIONS

Office Action (2 pages) dated Oct. 8, 2013, issued in corresponding Japanese Application No. 2011-259928 and English translation (2 pages).

* cited by examiner

*Primary Examiner* — Kenneth Bomberg
*Assistant Examiner* — Wesley Harris
(74) *Attorney, Agent, or Firm* — Nixon & Vanderhye PC

(57) ABSTRACT

A first housing has a first concave portion that opposes to a vane rotor, and the first concave portion has an inside diameter larger than an inside diameter of a first through hole of the first housing. A boss part of the vane rotor has a first convex portion projected into the first concave portion. A reed valve is arranged between an end surface of the first convex portion and a bottom surface of the first concave portion, and has an outside diameter larger than the inside diameter of the first through hole.

12 Claims, 12 Drawing Sheets

VALVE TIMING CONTROLLER

CROSS REFERENCE TO RELATED APPLICATION

This application is based on Japanese Patent Application No. 2011-259928 filed on Nov. 29, 2011, the disclosure of which is incorporated herein by reference in its entirety.

TECHNICAL FIELD

The present disclosure relates to a valve timing controller.

BACKGROUND

JP-2009-222025A describes a valve timing controller which controls opening and closing timing of an intake valve or an exhaust valve in an internal combustion engine by changing a rotation phase between a crankshaft and a camshaft. The valve timing controller has a housing rotating with the crankshaft, and a vane rotor rotating with the camshaft. The valve timing controller controls the valve timing by supplying working oil to an advance chamber or a retard chamber defined in the housing, so as to rotate the vane rotor.

A reed valve is disposed in an oil passage which supplies the working oil to the advance chamber and the retard chamber as a check valve. The valve timing controller includes the reed valve between the vane rotor and a cover that covers the reed valve. The reed valve is interposed between an end surface of the vane rotor and an end surface of the cover when the vane rotor and the reed valve are tightened using a bolt.

At this time, because the reed valve is not fixed, the reed valve has a possibility of dropping out before the bolt is fixed. Moreover, the bolt may be fastened while the reed valve falls out. Therefore, there is a possibility that the reed valve may be missing. Moreover, the number of components necessary for producing the valve timing controller is increased because the cover and the bolt are needed for fixing the reed valve.

Moreover, it is necessary to define a hole in the vane rotor for tightening the bolt, therefore the shape of the oil passage inside the vane rotor is restricted.

SUMMARY

It is an object of the present disclosure to provide a valve timing controller in which the reed valve is restricted from missing, the number of components is reduced, and the shape of the passage inside the vane rotor can be made flexible.

According to an example of the present disclosure, a valve timing controller that controls opening and closing timing of an intake valve or an exhaust valve in an internal combustion engine by controlling a rotation phase between a driving shaft and a driven shaft includes a first housing, a second housing, a vane rotor, a sleeve, a spool, and a reed valve. The first housing integrally rotates with the driving shaft and has a first through hole through which an end portion of the driven shaft passes. The second housing integrally rotates with the driving shaft and the first housing, and has a pipe part and a bottom part. The first housing closes a first end of the pipe part, and the bottom part closes a second end of the pipe part. The vane rotor integrally rotates with the driven shaft and has a boss part and a vane part. The boss part is located inside the second housing. The vane part partitions inside of the second housing into an advance chamber and a retard chamber. The vane rotor rotates on an advance side or a retard side relative to the second housing based on a pressure of working oil in the advance chamber and the retard chamber. A first supply passage is defined in the driven shaft and opens in an end surface of the driven shaft adjacent to the vane rotor. A second supply passage is defined in the vane rotor and opens in an end surface of the vane rotor adjacent to the first housing, and communicates with the first supply passage. The sleeve has a cylindrical shape arranged on an inner side from the boss part in a radial direction, and has a supply port communicating with the second supply passage, an advance port communicating with the advance chamber, and a retard port communicating with the retard chamber. The spool slidably moves in the sleeve in an axial direction among an advance position at which the supply port is connected to the advance port, a retard position at which the supply port is connected to the retard port, and a shutoff position at which the supply port is shutoff from the advance port and the retard port. The reed valve is interposed between the vane rotor and the driven shaft, and has a fixed part and a movable valve part. The fixed part has a second through hole that connects the first supply passage and the second supply passage with each other. The movable valve part is formed to extend from an edge of the second through hole to cover the second through hole so as to open or close an open end of the first supply passage. The reed valve allows the working oil to flow from the first supply passage to the second supply passage and prohibits the working oil from flowing from the second supply passage to the first supply passage.

One of the first housing and the boss part has a concave portion, and the other of the first housing and the boss part has a convex portion projected into the concave portion. The reed valve is arranged between the concave portion and the convex portion.

For example, the first housing has a first concave portion that opposes to the vane rotor, and the first concave portion has an inside diameter larger than an inside diameter of the first through hole. The boss part has a first convex portion projected into the first concave portion, and the end surface of the vane rotor is defined on the first convex portion. The reed valve is arranged between the end surface of the first convex portion and a bottom surface of the first concave portion, and has an outside diameter larger than the inside diameter of the first through hole.

For example, the boss part has a second concave portion that opposes to the first housing, and the second concave portion has an inside diameter larger than an inside diameter of the first through hole. The second concave portion has a bottom surface corresponding to the end surface of the vane rotor. The first housing has a second convex portion projected into the second concave portion, and the second convex portion has an outside diameter larger than the inside diameter of the first through hole. The reed valve is arranged between the bottom surface of the second concave portion and an end surface of the second convex portion, and has an outside diameter larger than the inside diameter of the first through hole.

Accordingly, the reed valve is restricted from missing, the number of components necessary for producing the valve timing controller is reduced, and the shape of the passage inside the vane rotor can be made flexible.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
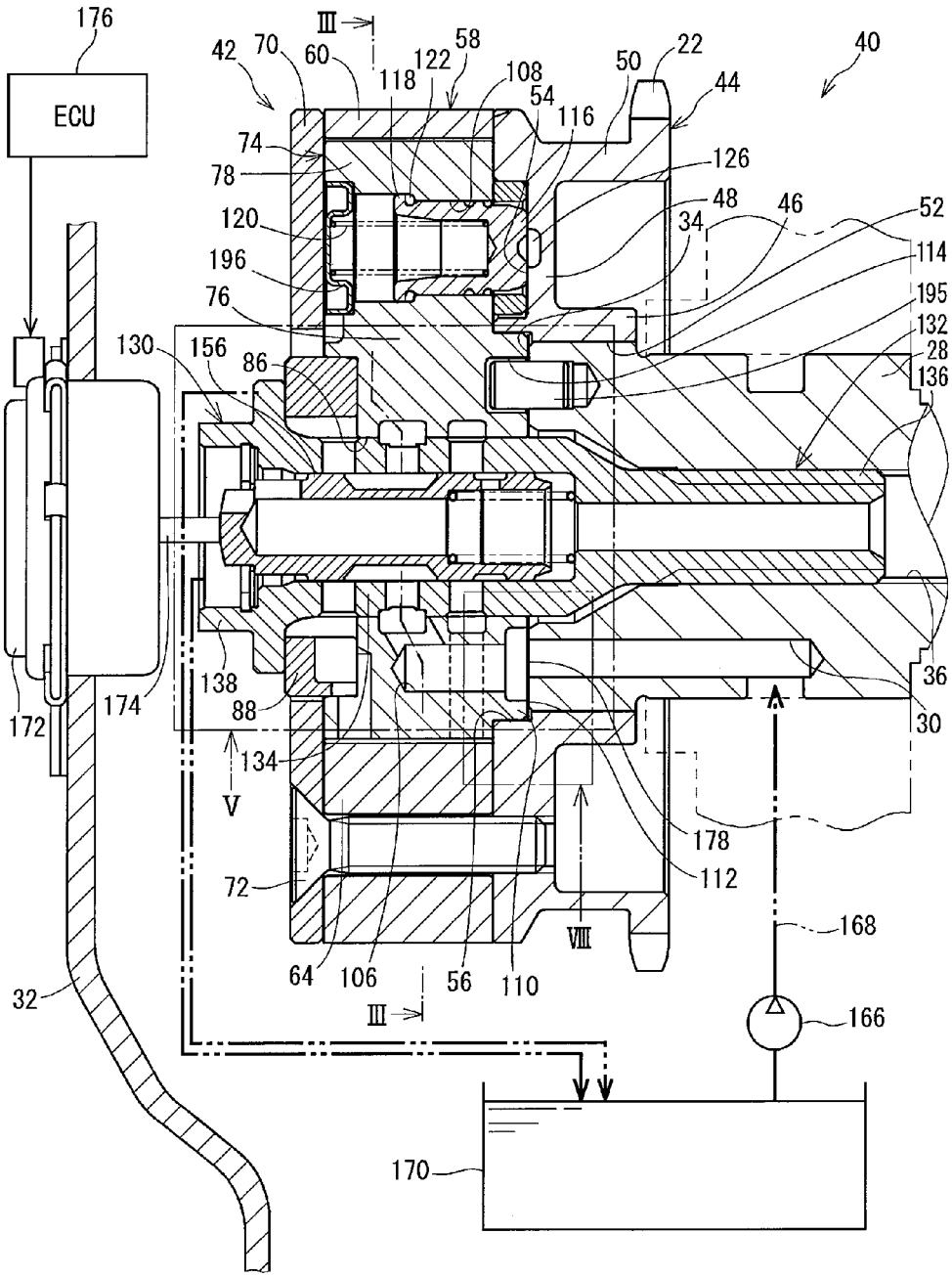
FIG. 1 is a schematic view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2:
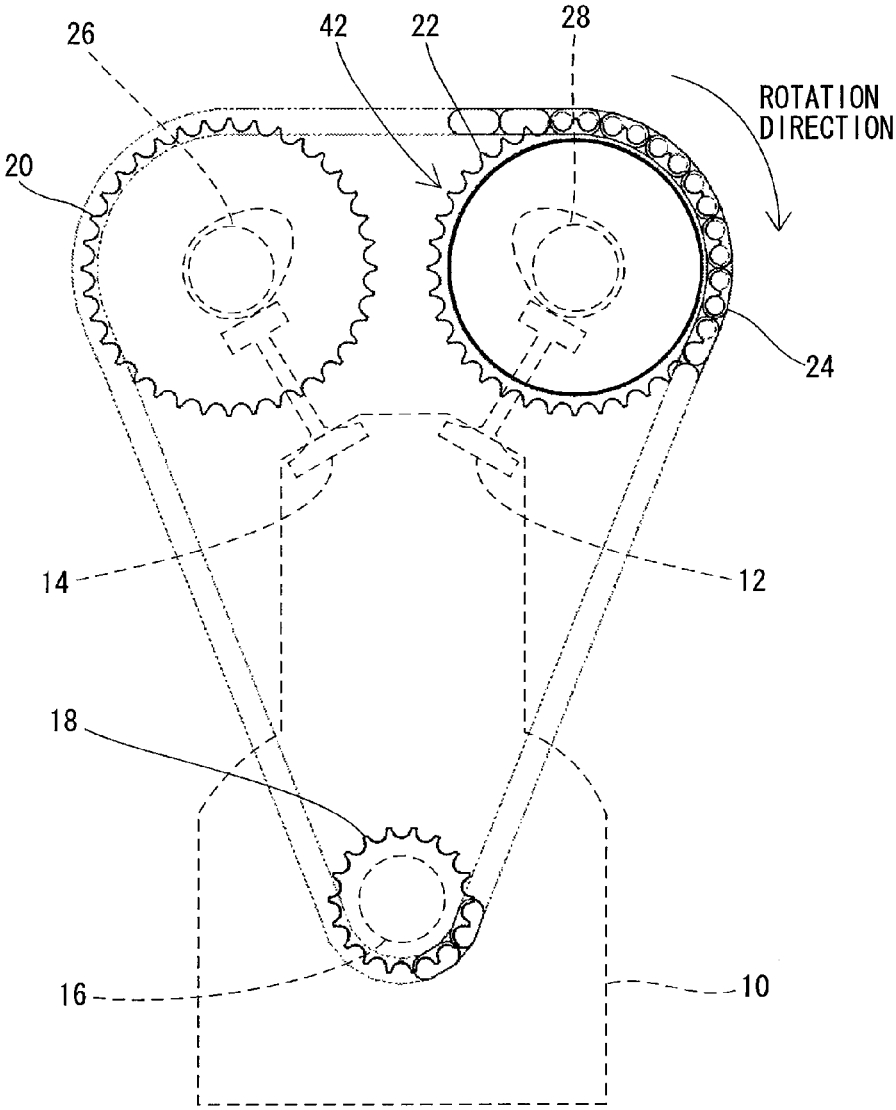
FIG. 2 is a schematic view illustrating an internal combustion engine having the valve timing controller.

A valve timing controller 42 according to a first embodiment is used in a valve timing control system 40 shown in FIG. 1. The valve timing control system 40 controls opening and closing timing of an intake valve 12 of an internal combustion engine 10 shown in FIG. 2. The intake valve 12 is rotated by a camshaft 28, and an exhaust valve 14 is rotated by a camshaft 26. Rotation of a gear 18 of a crankshaft 16 of the engine 10 is transmitted to gears 20, 22 through a chain 24.

The valve timing control system 40 advances the opening and closing timing of the intake valve 12 by rotating the camshaft 28 ahead in a rotation direction relative to the gear 22 rotating with the crankshaft 16.

The valve timing control system 40 retards the opening and closing timing of the intake valve 12 by rotating the camshaft 28 opposite from the rotation direction relative to the gear 22 rotating with the crankshaft 16.

Figure 3:
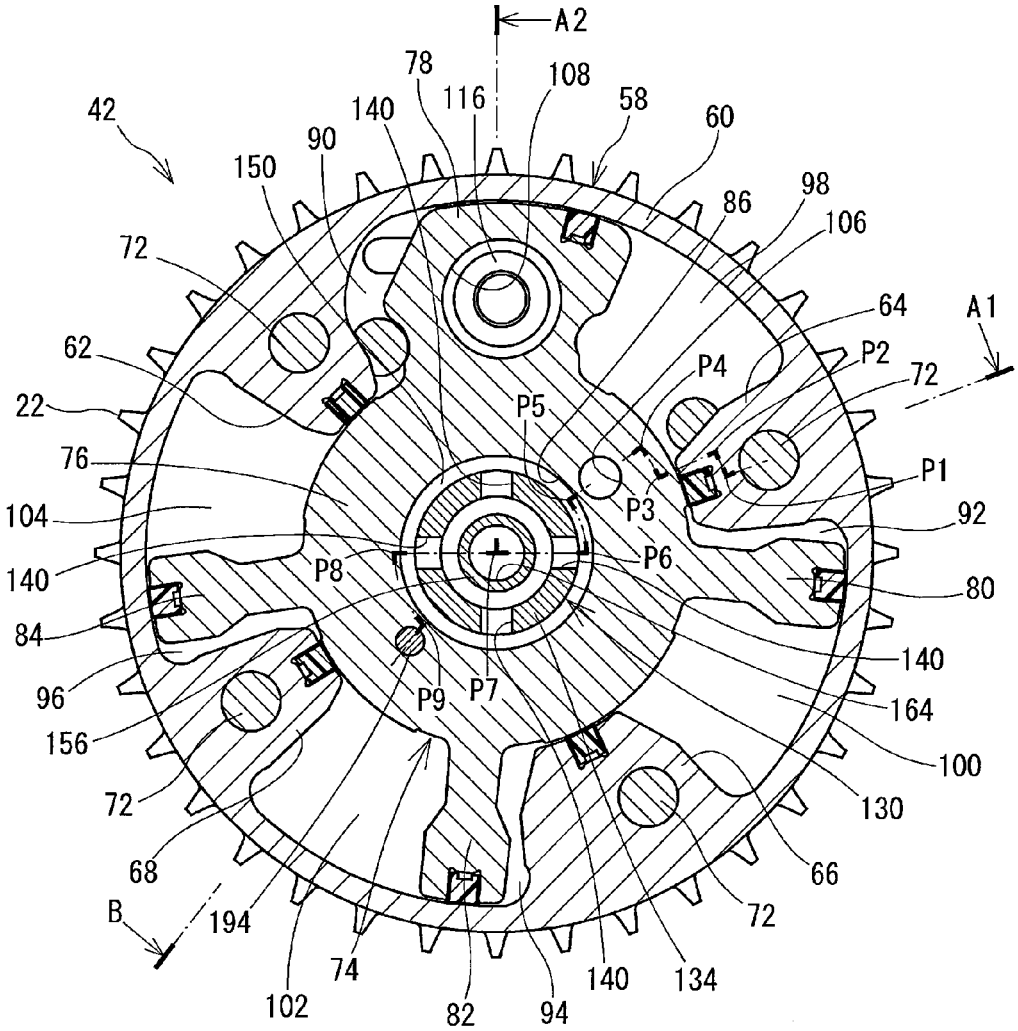
FIG. 3 is a cross-sectional view taken along a line of FIG. 1.

The valve timing control system 40 is explained with reference to FIGS. 1 and 3. FIG. 1 is a cross-sectional view taken along a line A1-P1-P2-P3-P4-P5-P6-P7-A2 of FIG. 3. As shown in FIG. 1, the valve timing control system 40 includes an oil pump 166, a motor cylinder 172, an electronic control unit (ECU) 176 in addition to the valve timing controller 42.

The valve timing controller 42 has a sprocket 44, a shoe housing 58, a front plate 70, a vane rotor 74, and a passage switching valve 130. The sprocket 44 may correspond to a first housing. The shoe housing 58 may correspond to a pipe part. The front plate 70 may correspond to a bottom part. The shoe housing 58 and the front plate 70 may construct a second housing.

Rotation of the crankshaft 16 is transmitted to the gear 22 of the sprocket 44 through the chain 24. The sprocket 44, the shoe housing 58, and the front plate 70 are integrally combined with each other, and integrally rotate with the crankshaft 16. The sprocket 44, the shoe housing 58, and the front plate 70 define a rotor accommodation space that accommodates the vane rotor 74.

The vane rotor 74 is integrally combined with the camshaft 28, and integrally rotates with the camshaft 28. The rotor accommodation space has advance chambers 90, 92, 94, 96 (hereinafter referred as 90-96) and retard chambers 98, 100, 102, 104 (hereinafter referred as 98-104), and the vane rotor 74 receives pressure of working oil supplied to the advance chambers 90-96 or the retard chambers 98-104 so as to rotate on the advance side or the retard side relative to the shoe housing 58.

The passage switching valve 130 switches a supply passage 106 inside of the vane rotor 74 to communicate with the advance chambers 90-96 or the retard chambers 98-104. The supply passage 106 may correspond to a second supply passage. The passage switching valve 130 is operated by the motor cylinder 172.

The oil pump 166 pumps working oil from an oil pan 170, and supplies the working oil to the passage switching valve 130 via a supply passage 168, a supply passage 30, and the supply passage 106. The supply passage 30 defined in the camshaft 28 may correspond to a first supply passage.

The motor cylinder 172 may be an electromagnetic type cylinder, and, as shown in FIG. 1, the motor cylinder 172 is attached to an engine cover 32. The motor cylinder 172 is arranged to have the same axis as a spool 156 of the passage switching valve 130. The motor cylinder 172 has a rod 174 and a solenoid (not shown). The rod 174 reciprocates in an axial direction. The solenoid is arranged on the outer side of the rod 174 in a radial direction. The rod 174 moves in the axial direction according to a magnetic field generated by the solenoid when the solenoid is energized. The rod 174 presses the spool 156 of the passage switching valve 130 in the axial direction.

The electronic control unit 176 drives the motor cylinder 172 in a manner that the rotation phase of the vane rotor 74 relative to the shoe housing 58 agrees with a target rotation phase. Specifically, when the rotation phase is on the retard side from the target rotation phase, the electronic control unit 176 controls the axial position of the spool 156 of the passage switching valve 130 in a manner that working oil is supplied to the advance chambers 90-96 of the valve timing controller 42. Moreover, when the rotation phase is on the advance side from the target rotation phase, the electronic control unit 176 controls the axial position of the spool 156 of the passage switching valve 130 in a manner that working oil is supplied to the retard chambers 98-104 of the valve timing controller 42. Moreover, when the rotation phase agrees with the target rotation phase, the electronic control unit 176 controls the axial position of the spool 156 of the passage switching valve 130 in a manner that the advance chambers 90-96 and the retard chambers 98-104 of the valve timing controller 42 are separated from the supply passage 106 and a discharge passage.

The valve timing controller 42 will be specifically described.

The sprocket 44 integrally has an inner cylinder portion 46, a flange portion 48 and an outer cylinder portion 50. The inner cylinder part 46 is fitted to an outer circumference wall of a first end of the camshaft 28. The flange part 48 is projected from the inner cylinder portion 46 outward in the radial direction. The outer cylinder portion 50 extends from the outer circumference of the flange portion 48 toward a second end of the camshaft 28. The inner cylinder portion 46 has a through hole 52 through which the camshaft 28 passes. The through hole 52 may correspond to a first through hole. The outer cylinder portion 50 has the gear 22.

The shoe housing 58 has a pipe part 60 and plural shoe parts 62, 64, 66, 68. A first end of the pipe part 60 is closed by the sprocket 44, and the plural shoe parts 62, 64, 66, 68 are projected inward in the radial direction from the pipe part 60. The shoe parts 62, 64, 66, 68 are arranged to be distanced from each other in the circumference direction of the pipe part 60.

The front plate 70 is a ring board member which closes a second end of the pipe part 60 of the shoe housing 58. The sprocket 44, the shoe housing 58, and the front plate 70 are integrally combined with each other using plural bolts 72.

The vane rotor 74 has a boss part 76 and plural vane parts 78, 80, 82, 84. The boss part 76 is located on the inner side from the shoe parts 62, 64, 66, 68 of the shoe housing 58 in the radial direction, and the plural vane parts 78, 80, 82, 84 are projected outward in the radial direction from the boss part 76. The vane rotor 74 is rotated relative to the sprocket 44, the shoe housing 58, and the front plate 70.

The boss part 76 has a first fitting hole 86 to which a sleeve part 134 of a sleeve bolt 132 is fitted. A center washer 88 is fitted to the boss part 76 at a position opposing to the front plate 70. The vane rotor 74 and the camshaft 28 are integrally combined with each other by the sleeve bolt 132 which passes through the center washer 88 and the vane rotor 74 to be tightened to the camshaft 28.

Four accommodation chambers are defined between the boss part 76 of the vane rotor 74 and the pipe part 60 of the shoe housing 58, and are divided by the shoe parts 62, 64, 66, 68. Each of the accommodation chambers accommodates the vane part 78, 80, 82, 84 in a manner that the vane part 78, 80, 82, 84 is relatively rotatable within a predetermined angle range. In FIG. 3, a clockwise rotation direction represents an advance direction, and a counterclockwise rotation direction represents a retard direction. The accommodation chamber is divided into the advance chamber 90, 92, 94, 96 and the retard chamber 98, 100, 102, 104 by the vane part 78, 80, 82, 84.

The vane part 78 of the vane rotor 74 has a receiving hole 108 penetrated in the axial direction as a through hole. The receiving hole 108 has a first part adjacent to the front plate 70 and a second part adjacent to the sprocket 44, and an inside diameter of the first part is larger than that of the second part through a step part. A lock pin 116 is received in the receiving hole 108 in a manner that the lock pin 116 reciprocates in the axial direction. The lock pin 116 is slidably movable relative to an inner wall of the second part of the receiving hole 108, and has a flange 118 projected outward in the radial direction inside of the first part of the receiving hole 108. The lock pin 116 is biased toward the sprocket 44 by a first spring 120 that is arranged adjacent to the front plate 70.

When the vane rotor 74 is located at an optimal position optimal for an engine start, the lock pin 116 is able to be fitted to a fitting concave portion 54 defined in the sprocket 44 adjacent to the vane rotor 74. The lock pin 116 regulates the relative rotation of the vane rotor 74 relative to the shoe housing 58 by fitting to the fitting concave portion 54 at the optimal position. In the first embodiment, the optimal position is set as the maximum retard position of the vane rotor 74, and the fitting concave portion 54 is formed to correspond to the lock pin 116 in a case where the vane rotor 74 is located at the maximum retard position.

A first unlock chamber 122 is defined to extend from the flange 118 of the lock pin 116 toward the sprocket 44. The first unlock chamber 122 is communicated with the advance chamber 90 via a passage (not shown). Moreover, a second unlock chamber 126 is defined between the lock pin 116 and the sprocket 44. The second unlock chamber 126 is communicated with the retard chamber 98 via a passage (not shown).

The pressure of the working oil supplied to the first unlock chamber 122 through the advance chamber 90 and the pressure of the working oil supplied to the second unlock chamber 126 through the retard chamber 98 act in a manner that the lock pin 116 comes out of the fitting concave portion 54. It is determined by a balance between the biasing force of the first spring 120 and the difference in the pressure of the working oil between the first unlock chamber 122 and the second unlock chamber 126 whether the vane rotor 74 is held at the optimal position by the lock pin 116.

The passage switching valve 130 has the sleeve bolt 132 and the spool 156. The sleeve bolt 132 integrally has a sleeve part 134, a thread part 136, and a head part 138 as a sleeve. The sleeve part 134 has a cylindrical shape, and is fitted with the first fitting hole 86 of the boss part 76 of the vane rotor 74 by passing through the center washer 88. The sleeve part 134 has a supply port 140, an advance port 144 and a retard port 148. The supply port 140 communicates with the supply passage 106. The advance port 144 communicates with the advance chambers 90-96 via an advance passage 142 defined inside of the vane rotor 74. The retard port 148 communicates with the retard chambers 98-104 via a retard passage 146 defined inside of the vane rotor 74.

The supply port 140 is defined, for example, at four positions arranged in the circumference direction, and communicates with the supply passage 106 via a first annular groove 150 defined in the inner wall of the first fitting hole 86. Moreover, the advance port 144 is defined, for example, at four positions arranged in the circumference direction, and communicates with the advance passage 142 via a second annular groove 152 defined in the inner wall of the first fitting hole 86. Moreover, the retard port 148 is defined, for example, at four positions arranged in the circumference direction, and communicates with the retard passage 146 via an annular oil passage 154 defined on the inner side from the center washer 88 in the radial direction.

The thread part 136 extends toward the camshaft 28 from the sleeve part 134, and is coupled to a tapped hole 36 defined in an end surface 34 of the camshaft 28.

The head part 138 has a cylindrical shape having the same axis as the sleeve part 134. The sleeve part 134 is located between the thread part 136 and the head part 138. The head part 138 has an outside diameter larger than that of the sleeve part 134.

The spool 156 is located on the inner side from the sleeve part 134 and the head part 138 in the radial direction. The spool 156 has a cylindrical shape having the same axis as the sleeve part 134. The spool 156 is slidably movable relative to the inner wall of the sleeve part 134 in the axial direction. The spool 156 is biased toward the front plate 70 by a second spring 157 which is arranged adjacent to the sprocket 44. The axial position of the spool 156 is determined by a balance between the biasing force of the second spring 157 and the thrust force of the rod 174 of the motor cylinder 172.

Figure 5:
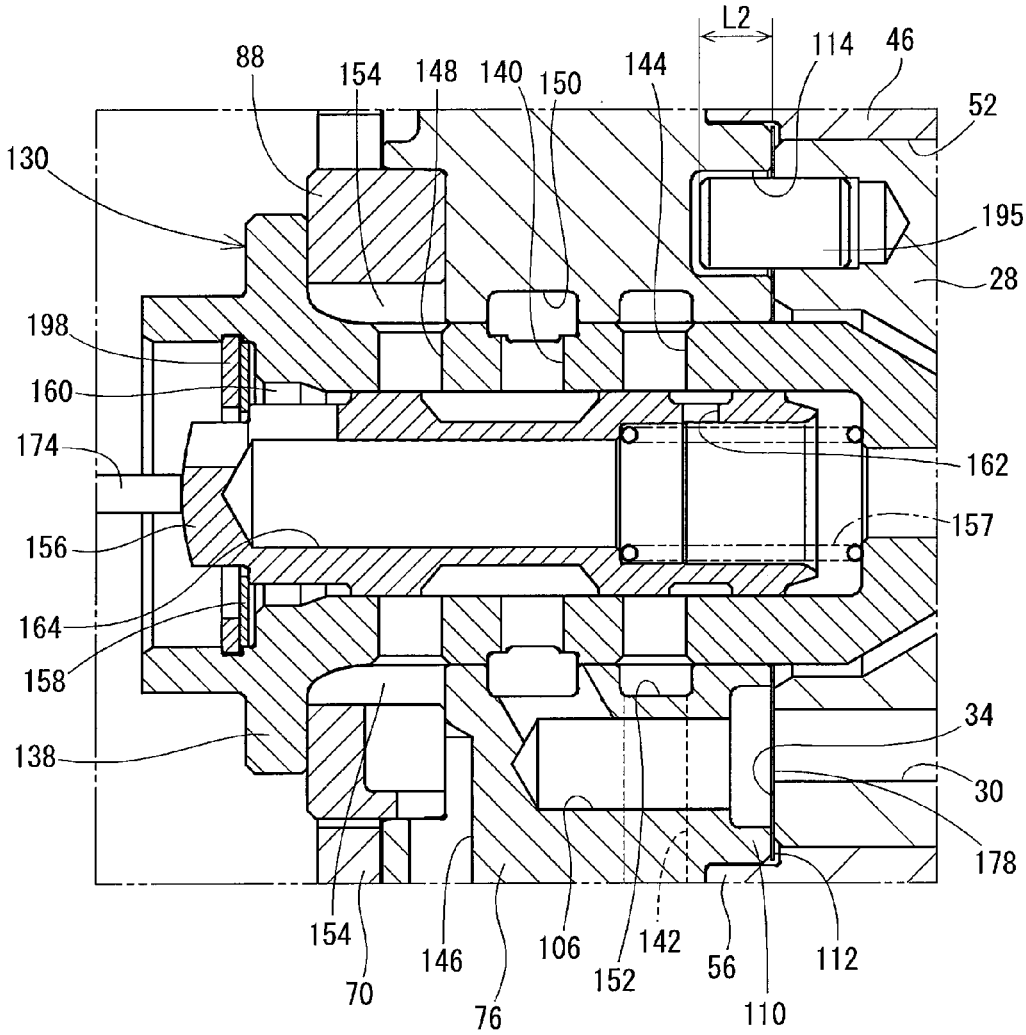
FIG. 5 is an enlarged cross-sectional view of a section V of FIG. 1 in which a spool is located at an advance position.

FIG. 5 illustrates the spool 156 located at an advance position. The spool 156 is made to contact a stopper plate 158 that is fitted to the inner wall of the head part 138 of the sleeve bolt 132. The spool 156 located at the advance position connects the supply port 140 of the sleeve part 134 to the advance port 144, and disconnects the supply port 140 from the retard port 148. Moreover, at the advance position, the working oil of the retard chambers 98-104 is discharged outside via the retard passage 146, the retard port 148, and a passage 160 defined between the sleeve bolt 132 and the spool 156. The passage 160 may be equivalent to the above-mentioned discharge passage.

Figure 6:
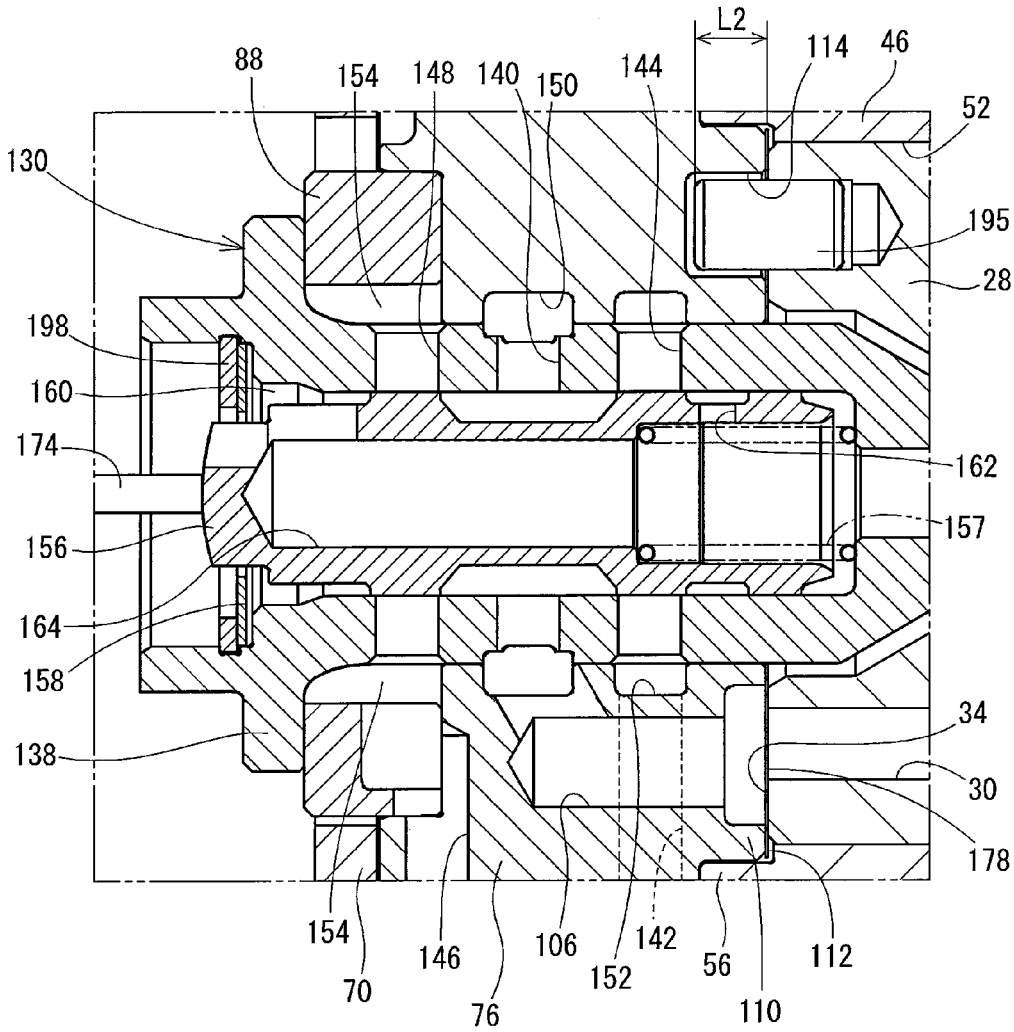
FIG. 6 is an enlarged cross-sectional view of a section V of FIG. 1 in which a spool is located at a shutoff position.

FIG. 6 illustrates the spool 156 located at a shutoff position. The radially outer surface of the spool 156 located at the shutoff position closes the advance port 144 and the retard port 148, thereby shutting off the supply port 140 of the sleeve part 134 from the advance port 144 and the retard port 148.

Figure 7:
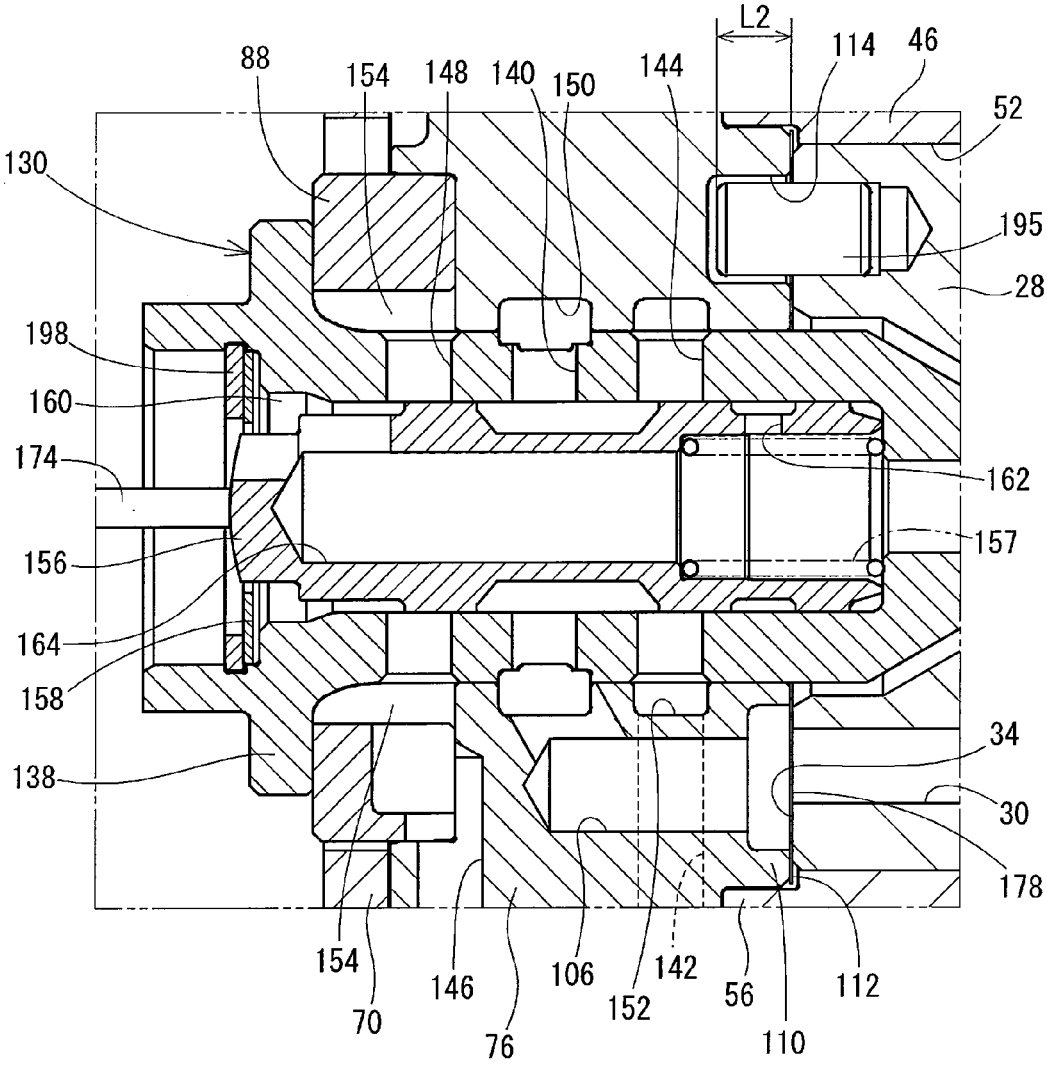
FIG. 7 is an enlarged cross-sectional view of a section V of FIG. 1 in which a spool is located at a retard position.

FIG. 7 illustrates the spool 156 located at a retard position. The spool 156 is made to contact the thread part 136 of the sleeve bolt 132. The spool 156 located at the retard position connects the supply port 140 of the sleeve part 134 to the retard port 148, and disconnects the supply port 140 from the advance port 144. Moreover, at the retard position, the working oil of the advance chambers 90-96 is discharged outside via the advance passage 142, the advance port 144, a hole 162 of the spool 156, and a radially inside passage 164 of the spool 156. The hole 162 and the radially inside passage 164 may be equivalent to the above-mentioned discharge passage.

The valve timing controller 42 includes a reed valve 178 and a control pin 194 in addition to the vane rotor 74 and the sprocket 44.

Figure 8:
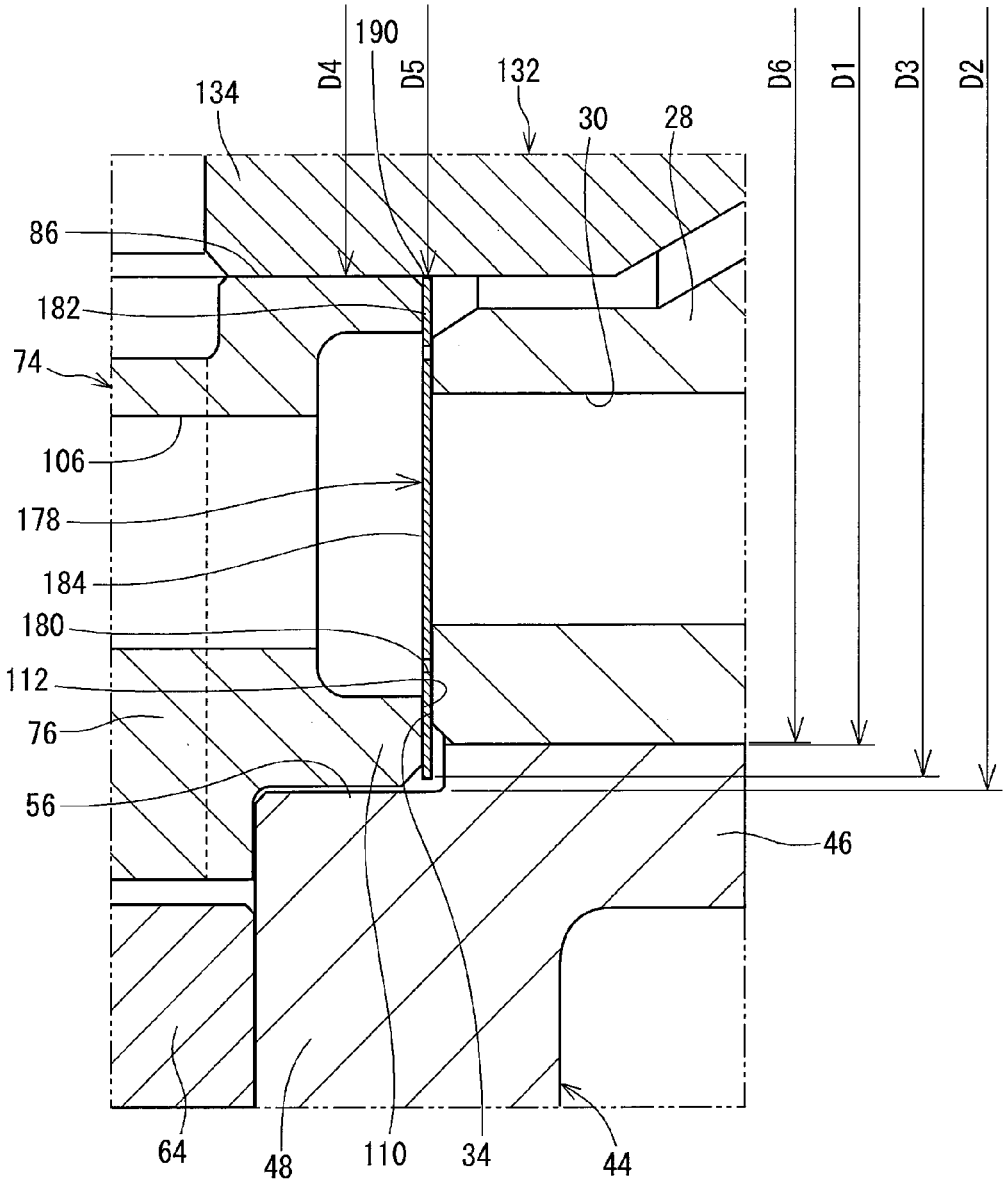
FIG. 8 is an enlarged cross-sectional view of a section VIII of FIG. 1.

As shown in FIGS. 5 and 8, the sprocket 44 has a concave portion 56 at a position opposing to the vane rotor 74, and an inside diameter D2 of the concave portion 56 is larger than an inside diameter D1 of the hole 52. Cross-sectional shape of the concave portion 56 which intersects perpendicularly to the axial direction is circular. The concave portion 56 may correspond to a first concave portion.

The boss part 76 of the vane rotor 74 has a convex portion 110 projected into the concave portion 56 of the sprocket 44. The convex portion 110 is relatively rotatable relative to the concave portion 56. Cross-sectional shape of the convex portion 110 which intersects perpendicularly to the axial direction is circular. The convex portion 110 may correspond to a first convex portion.

The reed valve 178 is arranged between the concave portion 56 of the sprocket 44 and the convex portion 110 of the vane rotor 74, and has a thin board shape having a thickness in the axial direction. The reed valve 178 is arranged between a tip end surface 112 of the convex portion 110 of the vane rotor 74 and the end surface 34 of the camshaft 28.

The reed valve 178 has a fixed part 182 and a movable valve part 184. The fixed part 182 has a through hole 180 that connects the first supply passage 30 and the second supply passage 106 with each other. The movable valve part 184 extends in the radial direction inside of the hole 180 from the edge of the hole 180. The tip end surface 112 may correspond to an end surface of the first convex portion, and the through hole 180 may correspond to a second through hole.

Figure 9:
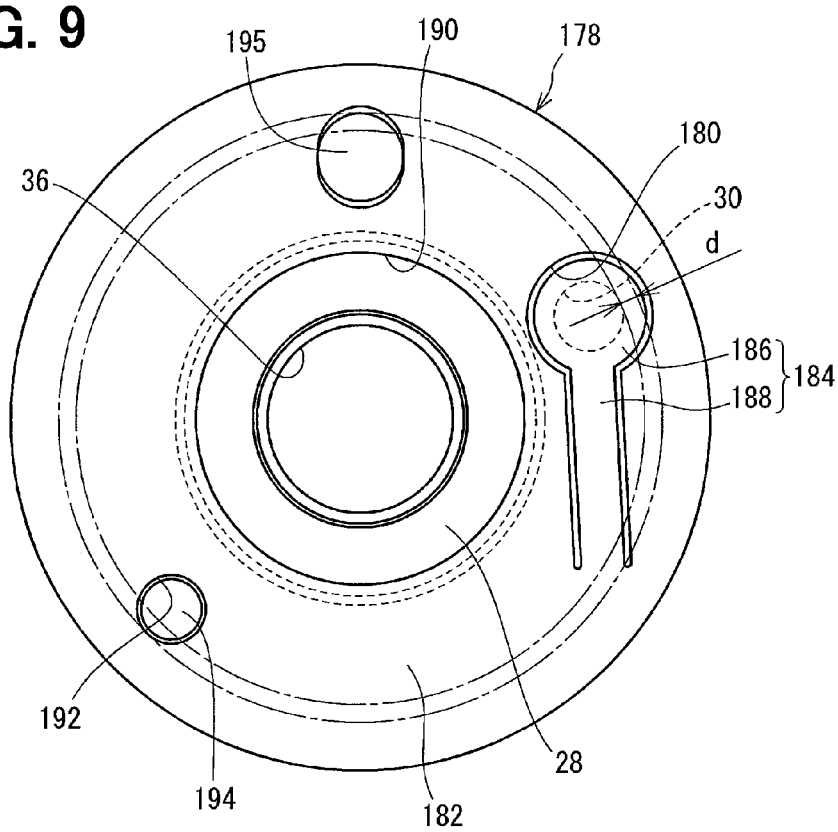
FIG. 9 is a side view illustrating a reed valve of the valve timing controller.

As shown in FIG. 9, the movable valve part 184 integrally has a lid part 186 and a flexible part 188. The lid part 186 closes the supply passage 30 defined in the end surface 34. The flexible part 188 connects the lid part 186 to the fixed part 182. When the pressure of the working oil in the supply passage 30 acts on the lid part 186, the flexible part 188 bends in a manner that the lid part 186 is distanced from the open end of the supply passage 30. The reed valve 178 is a check valve which allows the working oil to flow from the supply passage 30 to the supply passage 106 and prohibits the working oil from flowing from the supply passage 106 to the supply passage 30.

As shown in FIGS. 1, 5 and 8, the reed valve 178 is interposed between the tip end surface 112 of the convex portion 110 of the vane rotor 74 and the end surface 34 of the camshaft 28, and is integrally fixed to the vane rotor 74 and the camshaft 28. As shown in FIG. 8, the fixed part 182 of the reed valve 178 has an outside diameter D3 that is larger than the inside diameter D1 of the hole 52. Further, the outside diameter D3 of the reed valve 178 is smaller than the inside diameter D2 of the concave portion 56 of the sprocket 44. A clearance is defined between the outer wall of the reed valve 178 and the inner wall of the concave portion 56 of the sprocket 44 in the radial direction.

The fixed part 182 of the reed valve 178 has a second fitting hole 190 which is fitted to the outer circumference wall of the sleeve part 134. The second fitting hole 190 has an inside diameter D5 approximately equal to the inside diameter D4 of the first fitting hole 86. The axis of the reed valve 178 and the axis of the vane rotor 74 are made in agreement with each other by the second fitting hole 190. For example, the difference between the inside diameter D4 of the first fitting hole 86 and the inside diameter D5 of the second fitting hole 190 is less than 100 micrometers.

Figure 4:
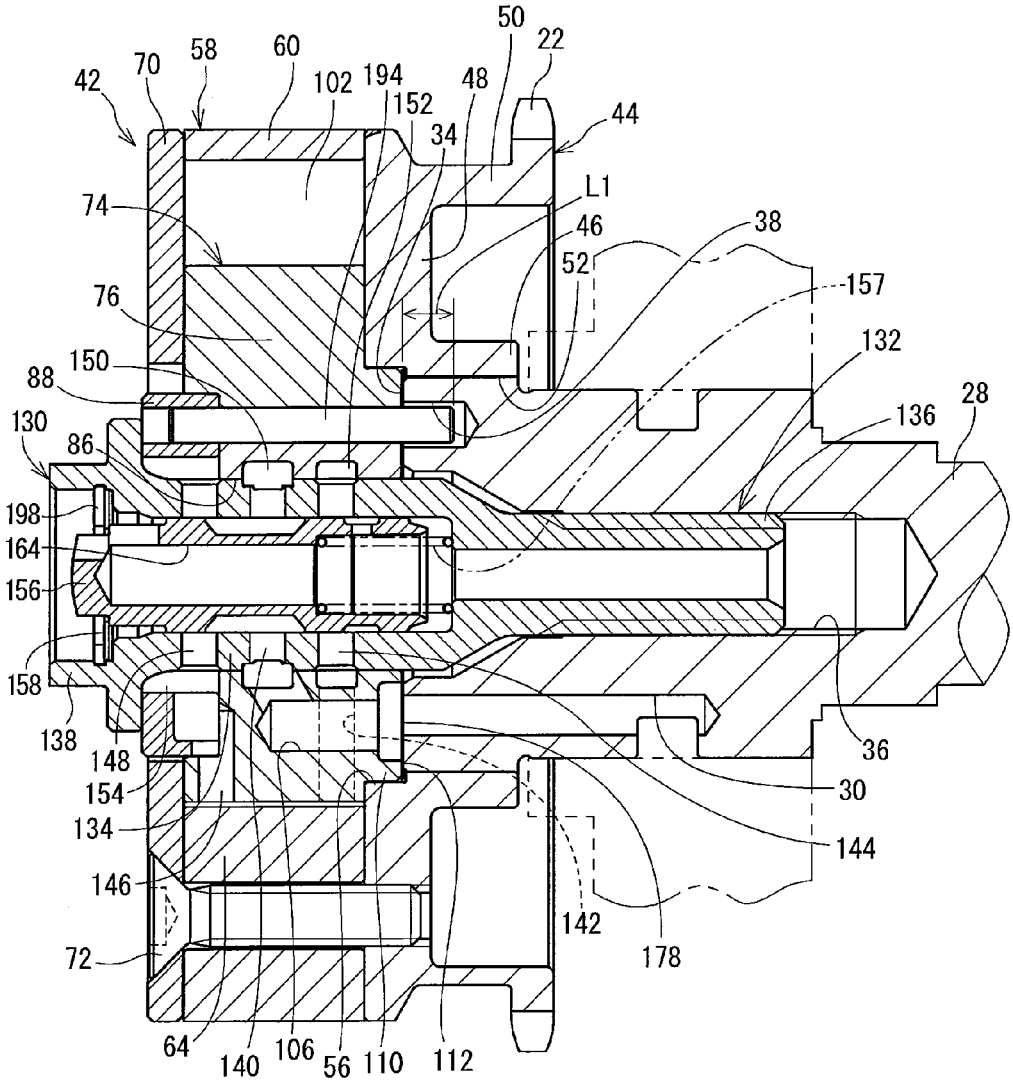
FIG. 4 is a cross-sectional view taken along a line A1-P1-P2-P3-P4-P5-P6-P7-P8-P9-B of FIG. 3.

As shown in FIG. 4, the control pin 194 is fixed to the vane rotor 74 as a regulator. The control pin 194 penetrates the vane rotor 74 in the axial direction. An end portion of the control pin 194 adjacent to the front plate 70 is fitted to the center washer 88. The other end portion of the control pin 194 adjacent to the sprocket 44 is projected from the tip end surface 112 of the convex portion 110 toward the camshaft 28, and is inserted into the first accommodation hole 38 defined in the end surface 34 of the camshaft 28.

As shown in FIG. 9, the fixed part 182 of the reed valve 178 has a hole 192 through which the control pin 194 passes. The control pin 194 is engaged with the inner wall of the hole 192 of the reed valve 178, thereby regulating the relative rotation of the reed valve 178 relative to the vane rotor 74.

As shown in FIG. 9, the control pin 194 is located at a position offset outward in the radial direction from the open end of the supply passage 30 defined in the end surface 34 of the camshaft 28 by an offset dimension "d". The offset dimension "d" is defined in the radial direction between the control pin 194 and the supply passage 30. Further, the offset dimension "d" is larger than half of the difference between the inside diameter D1 of the hole 52 and the outside diameter D6 of the camshaft 28 shown in FIG. 8. That is, even if the sprocket 44 moves in the radial direction relative to the camshaft 28 only by the dimension of the clearance, the control pin 194 cannot be inserted into the supply passage 30.

Figure 11:
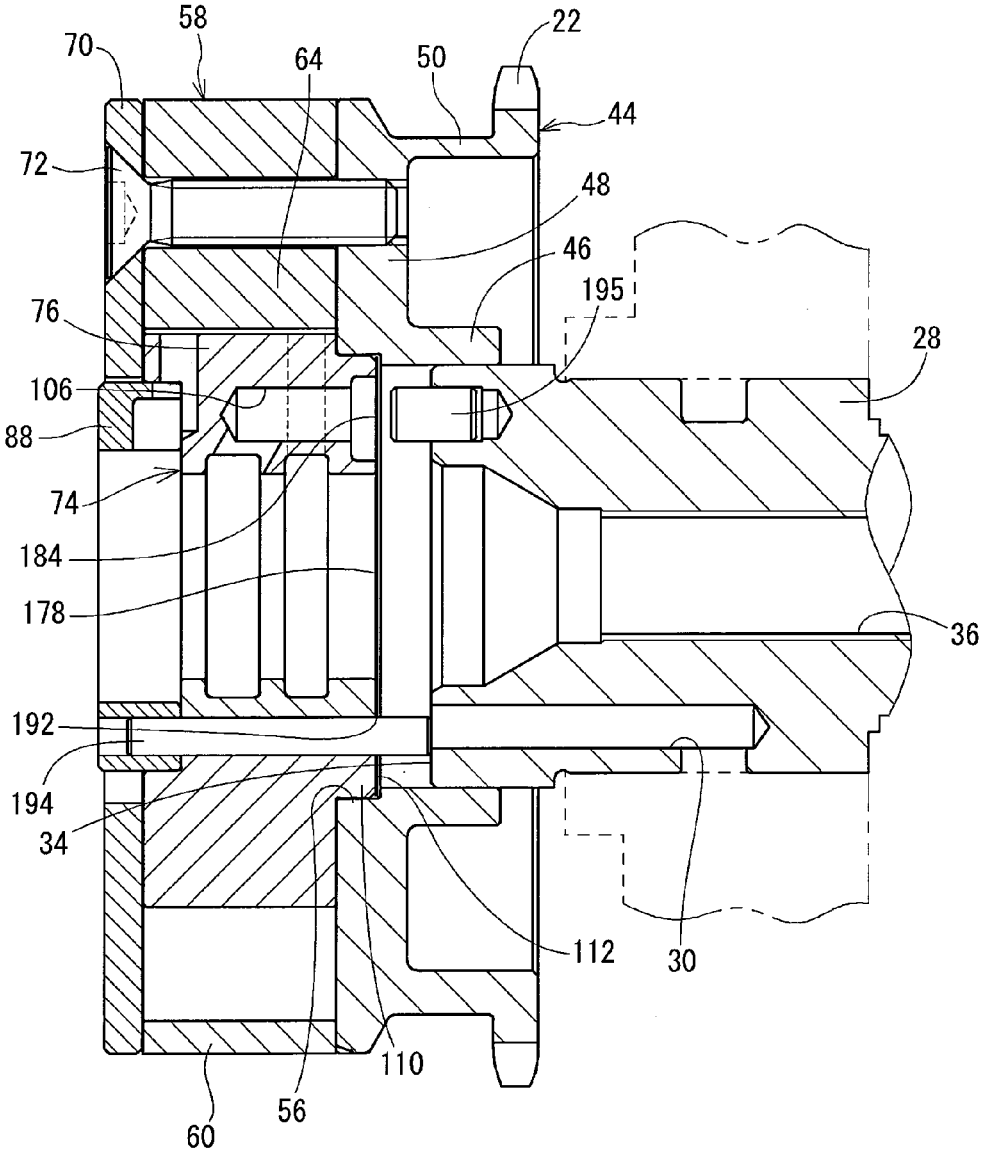
FIG. 11 is a view illustrating a process attaching the valve timing controller to a camshaft in which a control pin contacts an end surface of the camshaft.

As shown in FIG. 4, the convex portion 110 of the vane rotor 74 has a second accommodation hole 114. A knock pin 195 projected from the end surface 34 of the camshaft 28 toward the vane rotor 74 can be inserted into the second accommodation hole 114. The control pin 194 projects toward the camshaft 28 from the reed valve 178 by a projection dimension L1. The knock pin 195 projects toward the vane rotor 74 by a projection dimension L2. The projection dimension L1 is larger than the projection dimension L2. That is, when the control pin 194 contacts the end surface 34 of the camshaft 28, the knock pin 195 cannot contact the reed valve 178, as shown in FIG. 11.

Next, procedure assembling components to produce the valve timing controller 42 and procedure fixing the valve timing controller 42 to the engine 10 are explained. The procedure manufacturing the valve timing controller 42 is explained with reference to FIGS. 1 and 4 which illustrate a finished product, for convenience.

Figure 10:
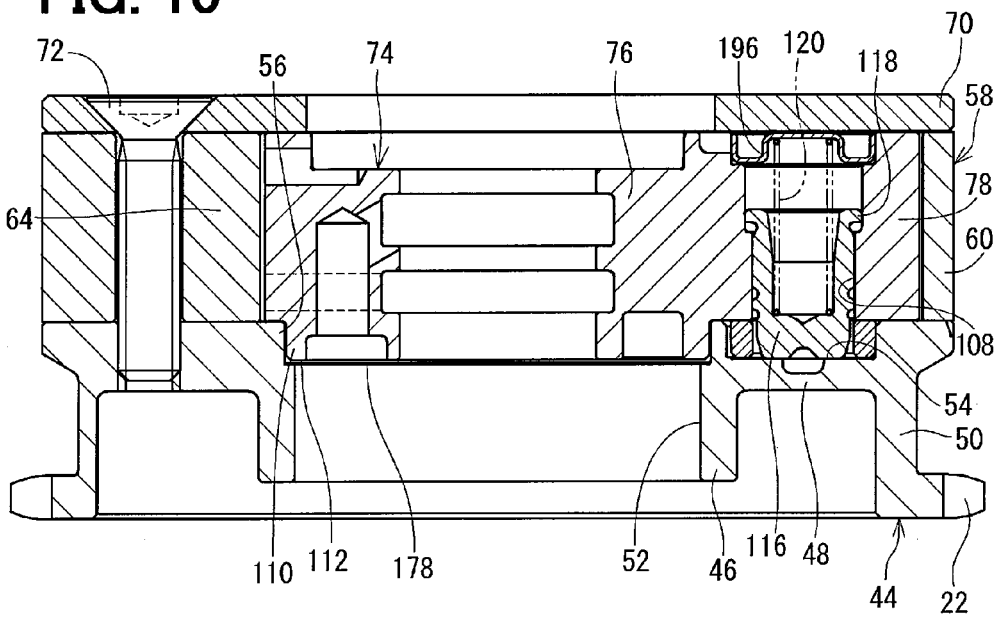
FIG. 10 is a view illustrating a process manufacturing the valve timing controller in which a sprocket, a shoe housing, and a front plate are tightened with each other using a bolt after a convex portion of a vane rotor is fitted with a concave portion of the sprocket.

As shown in FIG. 1, the lock pin 116, the first spring 120, and a spring receiver 196 are attached to the vane rotor 74 at first. The spring receiver 196 is pressingly fitted into the vane rotor 74. The reed valve 178 is arranged in the concave portion 56 of the sprocket 44. The vane rotor 74, the shoe housing 58, and the front plate 70 are arranged to the sprocket 44 in a manner that the convex portion 110 of the vane rotor 74 is fitted with the concave portion 56 of the sprocket 44, and are fastened using the bolt 72. The state immediately after the fastening of the vane rotor 74, the shoe housing 58, and the front plate 70 to the sprocket 44 is finished is shown in FIG. 10. Because the convex portion 110 is fitted into the concave portion 56 as shown in FIG. 10, the reed valve 178 does not come out of the concave portion 56 even if the vane rotor 74 is not fixed to the camshaft 28.

Then, as shown in FIG. 4, the center washer 88 is fitted into the center section of the vane rotor 74, and the control pin 194 is pressingly fitted, for example.

The second spring 157, the spool 156, and the stopper plate 158 are arranged in the sleeve bolt 132, and a snap ring 198 is fitted with the inner wall of the head part 138, so as to restrict the spool 156 from slipping off.

Thus, the valve timing controller 42 is assembled, for example, at the manufacture factory of the valve timing controller 42. Thereafter, the valve timing controller 42 is carried to a vehicle assembly factory, and is attached to the engine 10 at the vehicle assembly factory. While the valve timing controller 42 is carried from the manufacture factory to the vehicle assembly factory, if vibration is applied to the valve timing controller 42, the control pin 194 restricts the reed valve 178 from rotating relative to the vane rotor 74.

When the valve timing controller 42 is attached to the engine 10, the end portion of the camshaft 28 is inserted into the hole 52 of the sprocket 44 at first. At this time, while the position of the control pin 194 and the position of the first accommodation hole 38 are not in agreement in the circumference direction, as shown in FIG. 11, the control pin 194 contacts the end surface 34 of the camshaft 28, but the knock pin 195 does not contact the reed valve 178.

Figure 12:
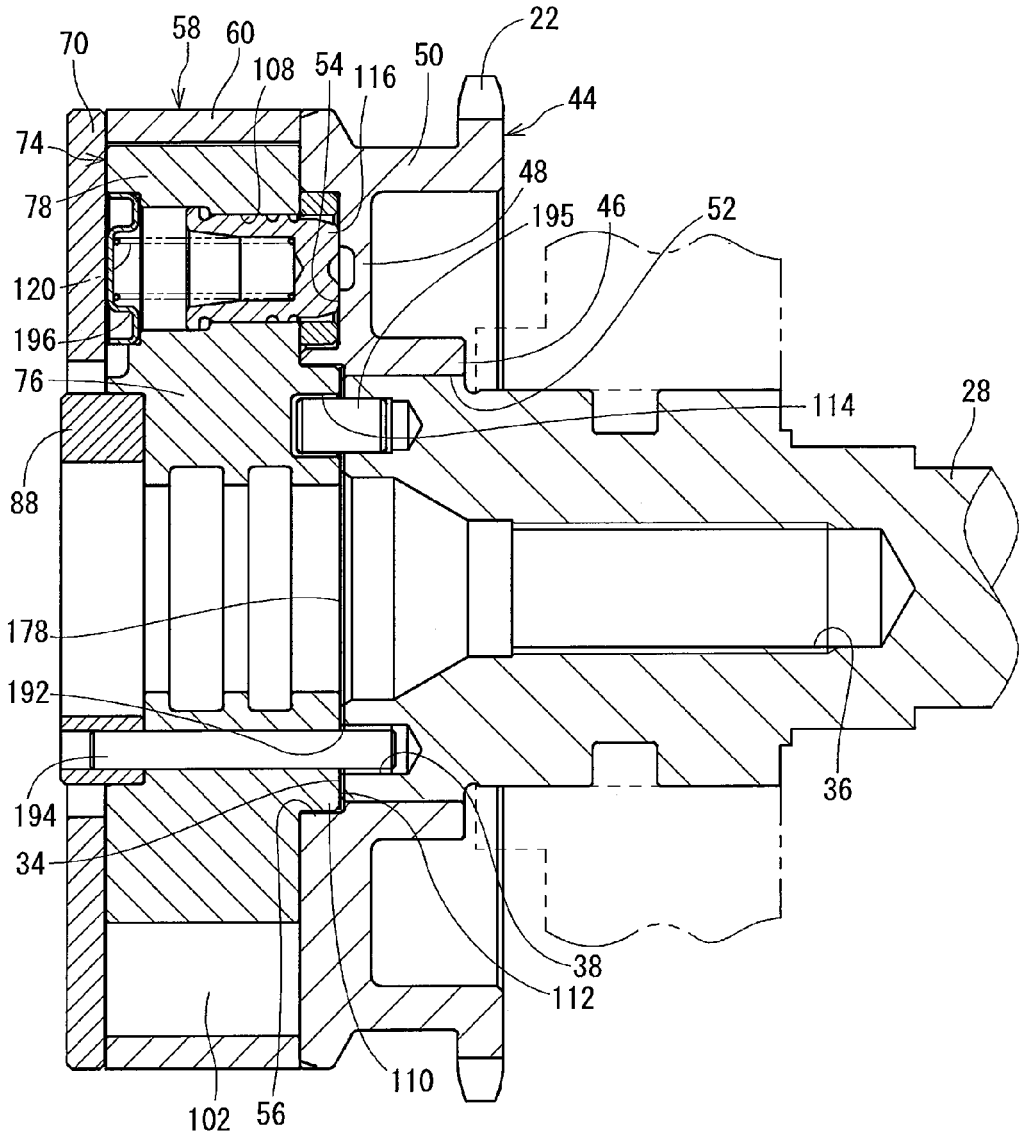
FIG. 12 is a view illustrating a process attaching the valve timing controller to the camshaft in which the control pin is inserted into a first accommodation hole of the camshaft.

When the position of the control pin 194 and the position of the first accommodation hole 38 are in agreement in the circumference direction, as shown in FIG. 12, the control pin 194 is inserted into the first accommodation hole 38, and the knock pin 195 is inserted into the second accommodation hole 114.

Then, as shown in FIG. 1, the valve timing controller 42 is fixed to the camshaft 28 with the sleeve bolt 132, thus the valve timing controller 42 is completely attached to the engine 10.

Next, operation of the valve timing controller 42 will be explained in detail.

When the rotation phase of the vane rotor 74 relative to the shoe housing 58 is on the retard side from a target rotation phase, the spool 156 of the passage switching valve 130 is moved to the advance position. At this time, as shown in FIGS. 1 and 5, the working oil is supplied from the oil pump 166 via the supply passage 168, the supply passage 30, the hole 180, the supply passage 106, and the first annular groove 150, to the supply port 140. The supplied oil flows into the advance chambers 90, 92, 94, 96 via the advance port 144 and the advance passage 142. On the other hand, the working oil of the retard chambers 98, 100, 102, 104 is discharged outside via the retard passage 146, the retard port 148, and the passage 160. Thus, the vane rotor 74 is advanced relative to the shoe housing 58.

Moreover, when the rotation phase of the vane rotor 74 relative to the shoe housing 58 is on the advance side from a target rotation phase, the spool 156 of the passage switching valve 130 is moved to the retard position. At this time, as shown in FIG. 7, the working oil is supplied from the oil pump 166 via the supply passage 168, the supply passage 30, the hole 180, the supply passage 106, and the first annular groove 150, to the supply port 140. The supplied oil flows into the retard chambers 98, 100, 102, 104 via the retard port 148 and the retard passage 146. On the other hand, the working oil of the advance chambers 90, 92, 94, 96 is discharged outside via the advance passage 142, the advance port 144, the hole 162 and the passage 164. Thereby, the vane rotor 74 is retarded relative to the shoe housing 58.

Moreover, when the rotation phase of the vane rotor 74 relative to the shoe housing 58 is in agreement with a target rotation phase, the spool 156 of the passage switching valve 130 is moved to the shutoff position. At this time, as shown in FIG. 6, the advance chambers 90, 92, 94, 96 are separated from the supply port 140 and the passage 164, and the retard chambers 98, 100, 102, 104 are separated from the supply port 140 and the passage 160. Thereby, the working oil stays in the advance chambers 90, 92, 94, 96 and the retard chambers 98, 100, 102, 104. As a result, the relative position of the vane rotor 74 does not change relative to the shoe housing 58.

The flow rate of the working oil supplied from the supply passage 30 to the supply passage 106 is fluctuated because the amount of the working oil discharged from the oil pump 166 fluctuates periodically. The reed valve 178 restricts the working oil from flowing backward to the supply passage 30 from the supply passage 106. Thereby, the pressure of the working oil of the supply passage 106 is restricted from declining while the working oil is supplied to each chamber. Therefore, the pressure of the working oil can be quickly raised in each chamber.

According to the first embodiment, the sprocket 44 has the concave portion 56 opposing to the vane rotor 74, and the inside diameter of the concave portion 56 is larger than the inside diameter of the hole 52. The boss part 76 of the vane rotor 74 has the convex portion 110 projected into the concave portion 56 of the sprocket 44. The reed valve 178 is disposed between the concave portion 56 of the sprocket 44 and the convex portion 110 of the vane rotor 74. The fixed part 182 of the reed valve 178 has the outside diameter which is larger than the inside diameter of the hole 52 of the sprocket 44.

Therefore, when the reed valve 178 is arranged in the concave portion 56 of the sprocket 44 and when the convex portion 110 of the vane rotor 74 is inserted into the concave portion 56, the reed valve 178 can be restricted from dropping out, while the vane rotor 74 is not fixed to the camshaft 28. Therefore, the reed valve 178 can be restricted from missing at the assembling time, and the lack of the reed valve 178 can be restricted.

According to the first embodiment, a component used for fixing the reed valve 178 such as cover or bolt becomes unnecessary compared with the conventional art, so the number of components necessary for producing the valve timing controller 42 can be reduced. Therefore, the number of assembling processes can be reduced and the manufacturing cost can be reduced.

Moreover, it becomes unnecessary to form a tapped hole in the vane rotor 74 because the bolt is unnecessary. Thus, the shape of the passage inside the vane rotor 74 is less limited.

Moreover, the vane rotor is restricted from having deformation, because the cover is not pressingly fitted into the vane rotor, so leakage of the working oil resulting from the deformation can be reduced.

According to the first embodiment, the outside diameter of the reed valve 178 is smaller than the inside diameter of the concave portion 56 of the sprocket 44. Therefore, a clearance is defined between the outer wall of the reed valve 178 and the inner wall of the concave portion 56 of the sprocket 44 in the radial direction. Therefore, when the reed valve 178 has relative rotation relative to the sprocket 44, the reed valve 178 is restricted from damaging the inner wall of the concave portion 56 of the sprocket 44.

According to the first embodiment, the boss part 76 of the vane rotor 74 has the first fitting hole 86 which is fitted to the radially outer wall of the sleeve part 134 of the sleeve bolt 132. Further, the fixed part 182 of the reed valve 178 has the second fitting hole 190 which is fitted to the radially outer wall of the sleeve part 134. The second fitting hole 190 has the inside diameter approximately equal to the inside diameter of the first fitting hole 86. Further, when the second fitting hole 190 is fitted to the radially outer wall of the sleeve part 134 of the sleeve bolt 132, the axis of the reed valve 178 and the axis of the vane rotor 74 can be aligned with each other. Therefore, when the sleeve bolt 132 is mounted to the vane rotor 74, simultaneously the axis alignment can be completed between the reed valve 178 and the vane rotor 74. Therefore, the reed valve 178 can be easily attached and the number of assembling processes can be reduced.

According to the first embodiment, the valve timing controller 42 is equipped with the control pin 194 that is fixed to the vane rotor 74. The control pin 194 is projected from the tip end surface 112 of the convex portion 110 toward the sprocket 44. The control pin 194 regulates the relative rotation of the reed valve 178 relative to the vane rotor 74 by engaging with the reed valve 178. The relative rotation of the reed valve 178 relative to the vane rotor 74 is regulated in a manner that the position of the lid part 186 of the movable valve part 184 of the vane rotor 74 and the position of the supply passage 30 of the end face 34 of the camshaft 28 are in agreement with each other in the circumference direction. Therefore, the reed valve 178 can be disposed in a manner that the lid part 186 of the movable valve part 184 can open or close the supply passage 30. Thus, the reed valve 178 can securely and properly work as a valve.

Moreover, if the position of the vane rotor 74 and the position of the lid part 186 of the movable valve part 184 of the reed valve 178 are in agreement with each other in the circumference direction when the valve timing controller 42 is attached to the camshaft 28, the position of the lid part 186 and the position of the supply passage 30 are made to agree with each other in the circumference direction, simultaneously, when the vane rotor 74 and the camshaft 28 are assembled at a predetermined position in the circumference direction. Therefore, special work for aligning the lid part 186 and the supply passage 30 in the circumference direction is unnecessary. Thus, the valve timing controller 42 can be easily assembled with small assembling processes.

Moreover, when the valve timing controller 42 is attached to the camshaft 28, the camshaft 28 and the knock pin 195 fixed to the camshaft 28 can be restricted from contacting the movable valve part 184 of the reed valve 178. Therefore, the reed valve 178 can be restricted from having deformation, and can work as a valve.

According to the first embodiment, the control pin 194 can be inserted into the first accommodation hole 38 opening in the end surface 34 of the camshaft 28. Moreover, the control pin 194 is located at the position offset outward or inward in the radial direction from the open end of the supply passage 30. Therefore, when the valve timing controller 42 is attached to the camshaft 28, the control pin 194 can be restricted from erroneously inserted into the supply passage 30, so error in the assembling process can be reduced.

According to the first embodiment, the deviation dimension in the radial direction between the control pin 194 and the supply passage 30 is larger than half of the difference between the inside diameter of the hole 52 and the outside diameter of the camshaft 28. Therefore, when the valve timing controller 42 is attached to the camshaft 28, the control pin 194 can be restricted from erroneously inserted into the supply passage 30 while the sprocket 44 moves in the radial direction relative to the camshaft 28, so error in the assembling process can be reduced.

According to the first embodiment, the boss part 76 of the vane rotor 74 has the second accommodation hole 114. The knock pin 195 projected from the end surface 34 of the camshaft 28 toward the vane rotor 74 can be inserted into the second accommodation hole 114. Moreover, the projection length of the control pin 194 adjacent to the sprocket 44 is larger than the projection length of the knock pin 195 adjacent to the vane rotor 74. Therefore, when the valve timing controller 42 is attached to the camshaft 28, while the position of the control pin 194 and the position of the first accommodation hole 38 do not agree with each other in the circumference direction, the control pin 194 contacts the end surface 34 of the camshaft 28, and the knock pin 195 can be restricted from contacting the reed valve 178.

Second Embodiment

Figure 13:
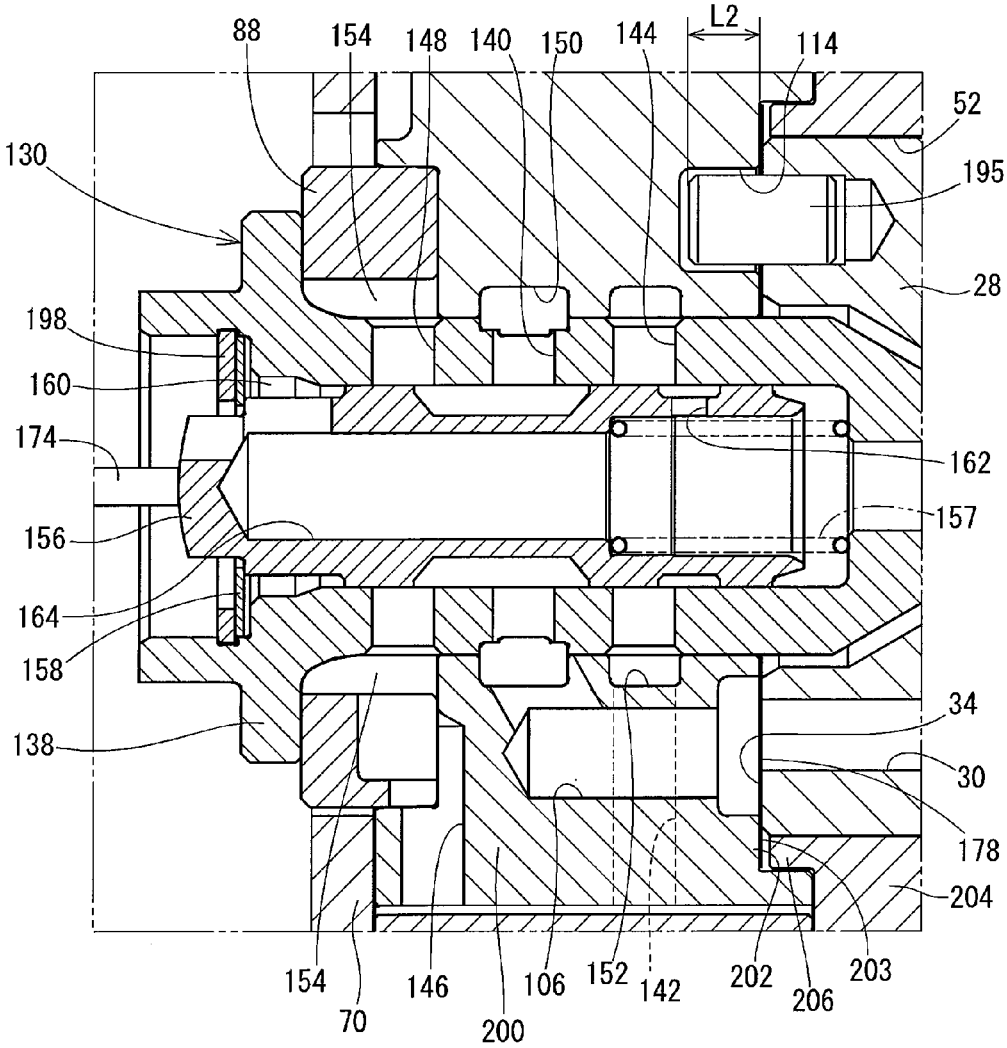
FIG. 13 is a cross-sectional view illustrating a part of a valve timing controller according to a second embodiment.

A valve timing controller according to a second embodiment will be described with reference to FIG. 13. As shown in FIG. 13, a vane rotor 200 has a concave portion 202 adjacent to a sprocket 204, and the sprocket 204 has a convex portion 206 adjacent to the vane rotor 200. The concave portion 202 has an inside diameter which is larger than the inside diameter of the hole 52 of the sprocket 204. Cross-sectional shape of the concave portion 202 is circular. The convex portion 206 is projected into the concave portion 202, and is relatively rotatable relative to the concave portion 202. Cross-sectional shape of the convex portion 206 is circular. The concave portion 202 may correspond to a second concave portion, and the convex portion 206 may correspond to a second convex portion.

The reed valve 178 is arranged between the concave portion 202 of the vane rotor 200 and the convex portion 206 of the sprocket 204. The fixed part 182 of the reed valve 178 has the outside diameter which is larger than the inside diameter of the hole 52 of the sprocket 204. The reed valve 178 is interposed between a bottom surface 203 of the concave portion 202 of the vane rotor 200 and the end face 34 of the camshaft 28, and is integrally fixed to the vane rotor 200 and the camshaft 28. The bottom surface 203 of the concave portion 202 of the vane rotor 200 may correspond to the end surface of the vane rotor.

According to the second embodiment, the reed valve 178 is arranged in the concave portion 202 of the vane rotor 200, and the convex portion 206 of the sprocket 204 is fitted into the concave portion 202. Therefore, the reed valve 178 can be restricted from dropping out while the vane rotor 200 is not fixed to the camshaft 28. Therefore, similarly to the first embodiment, the reed valve 178 can be restricted from missing at the assembling time, and lack of the reed valve 178 can be restricted.

Moreover, the number of components necessary for producing the valve timing controller can be reduced, and the design flexibility of the shape of the passage inside of the vane rotor 200 can be raised, similarly to the first embodiment.

Other Embodiments

The valve timing controller may control opening and closing timing of an exhaust valve instead of the intake valve.

The inside diameter of the second fitting hole of the reed valve may not be equal to the inside diameter of the first fitting hole of the vane rotor. The difference between the inside diameter of the second fitting hole of the reed valve and the inside diameter of the first fitting hole of the vane rotor may be larger than or equal to 100 micrometers.

The cross-sectional shape of the convex portion and the concave portion which intersects perpendicularly to the axial direction may other shape other than circular.

Moreover, the control pin may be eliminated, or may not be located at the position offset in the radial direction from the supply passage. The control pin may be arranged at a position offset inward, instead of outward, in the radial direction from the supply passage. The projection length of the control pin may be smaller than or equal to the projection length of the knock pin.

Moreover, the number of the vane parts of the vane rotor may be three or less, or may be five ore more. The number of the shoe parts of the housing may be three or Tess, or may be five or more.

Moreover, the gear integrally rotating with the sprocket and driven by the crankshaft through the chain may be prepared in the shoe housing or the front plate. In this case, the sprocket may be replaced with a cover covering an end part of the shoe housing.

The shoe housing and the front plate may be integrally constructed by the same component. The chain may be replaced with a belt or other transmission member.

The passage switching valve may be driven by an actuator other than the motor cylinder. The passage switching valve may be a pilot-acting type other than direct-acting type. The passage switching valve may be fixed by other fastening member other than the thread part of the sleeve bolt.

Such changes and modifications are to be understood as being within the scope of the present disclosure as defined by the appended claims.

What is claimed is:

1. A valve timing controller that controls opening and closing timing of an intake valve or an exhaust valve in an internal combustion engine by controlling a rotation phase between a driving shaft and a driven shaft comprising:

a first housing integrally rotating with the driving shaft and having a first through hole through which an end portion of the driven shaft passes;

a second housing integrally rotating with the driving shaft and the first housing and having a pipe part and a bottom part, the first housing closing a first end of the pipe part, the bottom part closing a second end of the pipe part;

a vane rotor integrally rotating with the driven shaft and having a boss part and a vane part, the boss part being located inside the second housing, the vane part partitioning inside of the second housing into an advance chamber and a retard chamber, the vane rotor rotating on an advance side or a retard side relative to the second housing based on a pressure of working oil in the advance chamber and the retard chamber;

a first supply passage defined in the driven shaft and opening in an end surface of the driven shaft adjacent to the vane rotor;

a second supply passage defined in the vane rotor and opening in an end surface of the vane rotor adjacent to the driven shaft the second supply passage communicating with the first supply passage;

a sleeve having a cylindrical shape arranged on an inner side from the boss part in a radial direction, the sleeve having a supply port communicating with the second supply passage, an advance port communicating with the advance chamber, and a retard port communicating with the retard chamber;

a spool slidably moving in the sleeve in an axial direction among an advance position at which the supply port is connected to the advance port, a retard position at which the supply port is connected to the retard port, and a shutoff position at which the supply port is shutoff from the advance port and the retard port; and a reed valve interposed between the vane rotor and the driven shaft, the reed valve having a fixed part and a movable valve part, the fixed part having a second through hole that connects the first supply passage and the second supply passage with each other, the movable valve part being formed to extend from an edge of the second through hole to cover the second through hole so as to open or close an open end of the first supply passage, the reed valve allowing the working oil to flow from the first supply passage to the second supply passage and prohibiting the working oil from flowing from the second supply passage to the first supply passage, a regulator fixed to the vane rotor, the regulator projecting into the driven shaft from the end surface of the vane rotor, wherein the first housing has a first concave portion that opposes to the vane rotor, and the first concave portion has an inside diameter larger than an inside diameter of the first through hole;

the boss part has a first convex portion projected into the first concave portion, and the first convex portion has an end surface corresponding to the end surface of the vane rotor;

the reed valve is arranged between the end surface of the first convex portion and a bottom surface of the first concave portion, and has an outside diameter larger than the inside diameter of the first through hole;

the regulator is engaged with the reed valve so as to restrict the reed valve from rotating relative to the vane rotor;

the regulator is configured to be inserted into a first accommodation hole defined in the end surface of the driven shaft, and the regulator is located at a position offset in the radial direction from the open end of the first supply passage defined in the end surface of the driven shaft.

2. The valve timing controller according to claim 1, wherein the reed valve rotates integrally with the vane rotor, and is rotatable relative to the first housing, and the outside diameter of the reed valve is smaller than the inside diameter of the first concave portion.

3. The valve timing controller according to claim 1, wherein the boss part has a first fitting hole fitted with an outer circumference wall of the sleeve, the fixed part of the reed valve has a second fitting hole fitted with an outer circumference wall of the sleeve, the second fitting hole has an inside diameter approximately the same as an inside diameter of the first fitting hole, and the second fitting hole causes an axis of the reed valve and an axis of the vane rotor to agree with each other when the second fitting hole is fitted with the outer circumference wall of the sleeve.

4. The valve timing controller according to claim 1, wherein a deviation dimension in the radial direction defined between the regulator and the first supply passage is larger than half of a difference between the inside diameter of the first through hole and an outside diameter of the driven shaft.

5. A valve timing controller that controls opening and closing timing of an intake valve or an exhaust valve in an internal combustion engine by controlling a rotation phase between a driving shaft and a driven shall comprising:

a first housing integrally rotating with the driving shaft and having a first through hole through which an end portion of the driven shaft passes;

a second housing integrally rotating with the driving shaft and the first housing and having a pipe part and a bottom part, the first housing closing a first end of the pipe part, the bottom part closing a second end of the pipe part;

a vane rotor integrally rotating with the driven shaft and having a boss part and a vane part, the boss part being located inside the second housing, the vane part partitioning inside of the second housing into an advance chamber and a retard chamber, the vane rotor rotating on an advance side or a retard side relative to the second housing based on a pressure of working oil in the advance chamber and the retard chamber;

a first supply passage defined in the driven shaft and opening in an end surface of the driven shaft adjacent to the vane rotor;

a second supply passage defined in the vane rotor and opening in an end surface of the vane rotor adjacent to the driven shaft, the second supply passage communicating with the first supply passage;

a sleeve having a cylindrical shape arranged on an inner side from the boss part in a radial direction, the sleeve having a supply port communicating with the second supply passage, an advance port communicating with the advance chamber, and a retard port communicating with the retard chamber;

a spool slidably moving in the sleeve in an axial direction among an advance position at which the supply port is connected to the advance port, a retard position at which the supply port is connected to the retard port, and a shutoff position at which the supply port is shutoff from the advance port and the retard port; and a reed valve interposed between the vane rotor and the driven shaft, the reed valve having a fixed part and a movable valve part, the fixed part having a second through hole that connects the first supply passage and the second supply passage with each other, the movable valve part being formed to extend from an edge of the second through hole to cover the second through hole so as to open or close an open end of the first supply passage, the reed valve allowing the working oil to flow from the first supply passage to the second supply passage and prohibiting the working oil from flowing from the second supply passage to the first supply passage, a regulator fixed to the vane rotor, the regulator projecting into the driven shaft from the end surface of the vane rotor, wherein the first housing has a first concave portion that opposes to the vane rotor, and the first concave portion has an inside diameter larger than an inside diameter of the first through hole;

the boss part has a first convex portion projected into the first concave portion, and the first convex portion has an end surface corresponding to the end surface of the vane rotor;

the reed valve is arranged between the end surface of the first convex portion and a bottom surface of the first concave portion, and has an outside diameter larger than the inside diameter of the first through hole;

the regulator is engaged with the reed valve so as to restrict the reed valve from rotating relative to the vane rotor;

the valve timing controller further comprises a knock pin projecting toward the vane rotor from the end surface of the driven shaft, wherein the knock pin is configured to be inserted into a second accommodation hole of the boss part, the regulator has a projection dimension projecting from the vane rotor toward the first housing, the knock pin has a projection dimension projecting from the driven shaft toward the vane rotor, and the projection dimension of the regulator is larger than the projection dimension of the knock pin.

6. The valve timing controller according to claim 5, wherein the reed valve rotates integrally with the vane rotor, and is rotatable relative to the first housing, and the outside diameter of the reed valve is smaller than the inside diameter of the first concave portion.

7. The valve timing controller according to claim 5, wherein the boss part has a first fitting hole fitted with an outer circumference wall of the sleeve, the fixed part of the reed valve has a second fitting hole fitted with an outer circumference wall of the sleeve, the second fitting hole has an inside diameter approximately the same as an inside diameter of the first fitting hole, and the second fitting hole causes an axis of the reed valve and an axis of the vane rotor to agree with each other when the second fitting hole is fitted with the outer circumference wall of the sleeve.

8. A valve timing controller that controls opening and closing timing of an intake valve or an exhaust valve in an internal combustion engine by controlling a rotation phase between a driving shaft and a driven shaft comprising:

a first housing integrally rotating with the driving shaft and having a first through hole through which an end portion of the driven shaft passes;

a second housing integrally rotating with the driving shaft and the first housing and having a pipe part and a bottom part, the first housing closing a first end of the pipe part, the bottom part closing a second end of the pipe part;

a vane rotor integrally rotating with the driven shaft and having a boss part and a vane part, the boss part being located inside the second housing, the vane part partitioning inside of the second housing into an advance chamber and a retard chamber, the vane rotor rotating on an advance side or a retard side relative to the second housing based on a pressure of working oil in the advance chamber and the retard chamber;

a first supply passage defined in the driven shaft and opening in an end surface of the driven shaft adjacent to the vane rotor;

a second supply passage defined in the vane rotor and opening in an end surface of the vane rotor adjacent to the driven shaft, the second supply passage communicating with the first supply passage;

a sleeve having a cylindrical shape arranged on an inner side from the boss part in a radial direction, the sleeve having a supply port communicating with the second supply passage, an advance port communicating with the advance chamber, and a retard port communicating with the retard chamber;

a spool slidably moving in the sleeve in an axial direction among an advance position at which the supply port is connected to the advance port, a retard position at which the supply port is connected to the retard port, and a shutoff position at which the supply port is shutoff from the advance port and the retard port;

a reed valve interposed between the vane rotor and the driven shaft, the reed valve having a fixed part and a movable valve part, the fixed part having a second through hole that connects the first supply passage and the second supply passage with each other, the movable valve part being formed to extend from an edge of the second through hole to cover the second through hole so as to open or close an open end of the first supply passage, the reed valve allowing the working oil to flow from the first supply passage to the second supply passage and prohibiting the working oil from flowing from the second supply passage to the first supply passage;

a regulator fixed to the vane rotor, the regulator projecting into the driven shaft from the end surface of the vane rotor; wherein the boss part has a second concave portion that opposes to the first housing, and the second concave portion has an inside diameter larger than an inside diameter of the first through hole, the second concave portion having a bottom surface corresponding to the end surface of the vane rotor;

the first housing has a second convex portion projected into the second concave portion, and the second convex portion has an outside diameter larger than the inside diameter of the first through hole; and the reed valve is arranged between the bottom surface of the second concave portion and an end surface of the second convex portion, and has an outside diameter larger than the inside diameter of the first through hole;

the regulator is engaged with the reed valve so as to restrict the reed valve from rotating relative to the vane rotor;

the regulator is configured to be inserted into a first accommodation hole defined in the end surface of the driven shaft, and the regulator is located at a position offset in the radial direction from the open end of the first supply passage defined in the end surface of the driven shaft.

9. The valve timing controller according to claim 8, wherein the boss part has a first fitting hole fitted with an outer circumference wall of the sleeve, the fixed part of the reed valve has a second fitting hole fitted with an outer circumference wall of the sleeve, the second fitting hole has an inside diameter approximately the same as an inside diameter of the first fitting hole, and the second fitting hole causes an axis of the reed valve and an axis of the vane rotor to agree with each other when the second fitting hole is fitted with the outer circumference wall of the sleeve.

10. The valve timing controller according to claim 8, wherein a deviation dimension in the radial direction defined between the regulator and the first supply passage is larger than half of a difference between the inside diameter of the first through hole and an outside diameter of the driven shaft.

11. A valve timing controller that controls opening and closing timing of an intake valve or an exhaust valve in an internal combustion engine by controlling a rotation phase between a driving shaft and a driven shaft comprising:

a first housing integrally rotating with the driving shaft and having a first through hole through which an end portion of the driven shaft passes;

a second housing integrally rotating with the driving shaft and the first housing and having a pipe part and a bottom part, the first housing closing a first end of the pipe part, the bottom part closing a second end of the pipe part;

a vane rotor integrally rotating with the driven shall and having a boss part and a vane part, the boss part being located inside the second housing, the vane part partitioning inside of the second housing into an advance chamber and a retard chamber, the vane rotor rotating on an advance side or a retard side relative to the second housing based on a pressure of working oil in the advance chamber and the retard chamber;

a first supply passage defined in the driven shaft and opening in an end surface of the driven shaft adjacent to the vane rotor;

a second supply passage defined in the vane rotor and opening in an end surface of the vane rotor adjacent to the driven shaft, the second supply passage communicating with the first supply passage;

a sleeve having a cylindrical shape arranged on an inner side from the boss part in a radial direction, the sleeve having a supply port communicating with the second supply passage, an advance port communicating with the advance chamber, and a retard port communicating with the retard chamber;

a spool slidably moving in the sleeve in an axial direction among an advance position at which the supply port is connected to the advance port, a retard position at which the supply port is connected to the retard port, and a shutoff position at which the supply port is shutoff from the advance port and the retard port;

a reed valve interposed between the vane rotor and the driven shaft, the reed valve having a fixed part and a movable valve part, the fixed part having a second through hole that connects the first supply passage and the second supply passage with each other, the movable valve part being formed to extend from an edge of the second through hole to cover the second through hole so as to open or close an open end of the first supply passage, the reed valve allowing the working oil to flow from the first supply passage to the second supply passage and prohibiting the working oil from flowing from the second supply passage to the first supply passage;

a regulator fixed to the vane rotor, the regulator projecting into the driven shaft from the end surface of the vane rotor; wherein the boss part has a second concave portion that opposes to the first housing, and the second concave portion has an inside diameter larger than an inside diameter of the first through hole, the second concave portion having a bottom surface corresponding to the end surface of the vane rotor;

the first housing has a second convex portion projected into the second concave portion, and the second convex portion has an outside diameter larger than the inside diameter of the first through hole;

the reed valve is arranged between the bottom surface of the second concave portion and an end surface of the second convex portion, and has an outside diameter larger than the inside diameter of the first through hole;

the regulator is engaged with the reed valve so as to restrict the reed valve from rotating relative to the vane rotor;

the valve timing controller further comprises a knock pin projecting toward the vane rotor from the end surface of the driven shaft, wherein the knock pin is configured to be inserted into a second accommodation hole of the boss part, the regulator has a projection dimension projecting from the vane rotor into the driven shaft, the knock pin has a projection dimension projecting from the driven shaft toward the vane rotor, and the projection dimension of the regulator is larger than the projection dimension of the knock pin.

12. The valve timing controller according to claim 11, wherein the boss part has a first fitting hole fitted with an outer circumference wall of the sleeve, the fixed part of the reed valve has a second fitting hole fitted with an outer circumference wall of the sleeve, the second fitting hole has an inside diameter approximately the same as an inside diameter of the first fitting hole, and the second fitting hole causes an axis of the reed valve and an axis of the vane rotor to agree with each other when the second fitting hole is fitted with the outer circumference wall of the sleeve.

* * * * *